US007404745B1

(12) United States Patent
Wu

(10) Patent No.: US 7,404,745 B1
(45) Date of Patent: Jul. 29, 2008

(54) TERMINAL CONTACT AND CLAMP ASSEMBLY FOR A CABLE TERMINAL BLOCK AND METHOD FOR PROCESSING THE SAME

(76) Inventor: Chih-Yuan Wu, 8 Fl., No. 66, Chung-Chen Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 11/987,599

(22) Filed: Dec. 3, 2007

Related U.S. Application Data

(63) Continuation-in-part of application No. 11/730,601, filed on Apr. 3, 2007, now abandoned.

(51) Int. Cl.
*H01R 4/36* (2006.01)

(52) U.S. Cl. ..... 439/811; 439/709

(58) Field of Classification Search ..... 439/709, 439/810, 811–814, 718
See application file for complete search history.

(56) References Cited

U.S. PATENT DOCUMENTS

| | | | | |
|---|---|---|---|---|
| 3,124,409 | A * | 3/1964 | Nisula | 439/791 |
| 4,070,086 | A * | 1/1978 | Trafford | 439/717 |
| 5,934,818 | A * | 8/1999 | Schmitt et al. | 403/399 |
| 6,719,593 | B2 * | 4/2004 | Garcia et al. | 439/811 |
| 7,172,470 | B2 * | 2/2007 | Takaya et al. | 439/811 |

* cited by examiner

*Primary Examiner*—Hien Vu
(74) *Attorney, Agent, or Firm*—Posz Law Group, PLC

(57) ABSTRACT

A terminal contact and clamp assembly has a cage clamp and an inner contact. The cage clamp has a top, a bottom, a through hole multiple bottom teeth and at least one protruding tooth. The bottom has an inner bottom surface. The bottom teeth are formed on the inner bottom surface. The at least one protruding tooth is formed on and protrudes up from the inner bottom surface and has a top end higher than the inner bottom surface. The inner contact is mounted in the through hole. The at least one protruding tooth deeply bites an exposed wire core of a cable and prevents the cable from slipping out of the terminal contact and clamp assembly.

5 Claims, 12 Drawing Sheets

TERMINAL CONTACT AND CLAMP ASSEMBLY FOR A CABLE TERMINAL BLOCK AND METHOD FOR PROCESSING THE SAME

The present invention is a continuation-in-part application of a U.S. patent application Ser. No. 11/730,601 filed on Apr. 3, 2007 now abandoned.

BACKGROUND OF THE INVENTION

1. Field of the Invention

The present invention relates to a terminal contact and clamp assembly, and more particularly to a terminal contact and clamp assembly for a cable terminal block and a method for processing the terminal contact and clamp assembly. The terminal contact and clamp assembly securely and tightly bites and holds an exposed wire core at one end of a cable.

2. Description of Related Art

Cable terminal blocks are used generally in electronic devices for holding ends of cables so that the electronic devices are capable of transmitting power or electronic signals to other devices through the cables.

With reference to FIGS. 7 and 8, a conventional cable terminal block comprises a casing (90) and a contact and clamp assembly.

The casing (90) has a cavity (91) and a mounting hole (92). The cavity (91) is defined in the casing (90) for holding one end of a cable (99) having a wire core exposed at the end. The mounting hole (92) is defined in the casing (90) and communicates with the cavity (91).

The contact and clamp assembly is mounted in the cavity (91) and has a cage clamp (95), an inner contact (96), an outer contact (97) and a bolt (98). The cage clamp (95) is conductive, is mounted in the cavity (91) and has an inner bottom surface, a front open end, a rear open end, a threaded hole (953), a through hole and multiple bottom teeth (951). The threaded hole (953) is defined through the top of the cage clamp (95). The through hole is defined laterally through the cage clamp (95) and communicates with the threaded hole (953) and the front and rear open ends. The bottom teeth (951) are formed on the inner bottom surface with a punching process.

The inner contact (96) is conductive, is mounted through the rear open end of the cage clamp (95), cooperates with the cage clamp (95) to clamp and hold the end of the cable (99) and has an inner top surface and multiple top teeth (961). The top teeth (961) are formed on the inner top surface with a punching process and correspond to and cooperate with the bottom teeth (951) to clamp and hold exposed wire core at the end of the cable (99).

The outer contact (97) is conductive, is mounted through the rear open end of the cage clamp (95) and is stacked on the inner contact (96).

The bolt (98) is mounted through the mounting hole (92) and the threaded hole (953) and presses against the outer contact (97) and the inner contact (96) to clamp the exposed wire core at the end of the cable (99) with the cage clamp (95).

However, the bottom and top teeth (951, 961) formed with punching processes are not sharp so that the wire core of the cable (99) cannot be bitten tightly by the bottom and top teeth (951, 961) and would therefore slip out of the contact and clamp assembly.

With reference to FIGS. 9A to 9C, a conventional method for pressing the contact and clamp assembly comprises aligning a punch die (85) with a workpiece (80) as shown in FIG. 9A and punching a surface of the workpiece (80) with the punch die (85) to finish a product, as shown in FIGS. 9B and 9C. The punch die (85) has multiple punching teeth (851) and multiple V-shaped grooves located respectively between adjacent punching teeth (851). The workpiece (80) is made of bronze or red copper. The punching teeth (851) on the punch die (85) punches in the surface to form multiple indents and multiple teeth (951, 961) arranged alternately with the indents. The pressed metal workpiece is processed later to form the cage clamp (95) or inner contact (96) and the teeth (951, 961).

However, the conventional method has following disadvantages.

1. When the punching teeth (851) punches the workpiece (80), material of the workpiece (80) cannot entirely fill the V-shaped grooves so that the teeth (951, 961) formed from the material filling into the V-shaped grooves are round instead of being sharp. Accordingly, the round teeth (951, 961) on the cage clamp (95) or inner contact (96) formed from the workpiece (80) barely bite the end cable (95) and easily allow the cable to slip out of the contact and clamp assembly, especially when the cable has a multi-core.

2. The workpiece (80) made of bronze or red copper with a low hardness as compared with iron or steel so that the teeth (951, 961) are round.

3. The wire core of the cable (99) may be a single core or a multi-core having a bundle of core elements. When the wire core is a single core, the contact and clamp assembly barely bites and holds the single core. However, when the wire core is a multi-core, the contact and clamp assembly hardly bites and holds the multi-core and the cable easily slip out of the contact and clamp assembly.

To overcome the shortcomings, the present invention provides a terminal contact and clamp assembly for a cable terminal block and a method for processing a terminal contact and clamp assembly to mitigate or obviate the aforementioned problems.

SUMMARY OF THE INVENTION

The main objective of the invention is to provide a terminal contact and clamp assembly for a cable terminal block and a method for processing a terminal contact and clamp assembly. The terminal contact and clamp assembly securely and tightly bites and holds an exposed wire core on one end of a cable.

A terminal contact and clamp assembly in accordance with the present invention has a cage clamp and an inner contact. The cage clamp has a top, a bottom, a through hole, multiple bottom teeth and at least one protruding tooth. The bottom has an inner bottom surface. The bottom teeth are formed on the inner bottom surface. The at least one protruding tooth is formed on and protrudes up from the inner bottom surface and has a top end higher than the inner bottom surface. The inner contact is mounted in the through hole.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
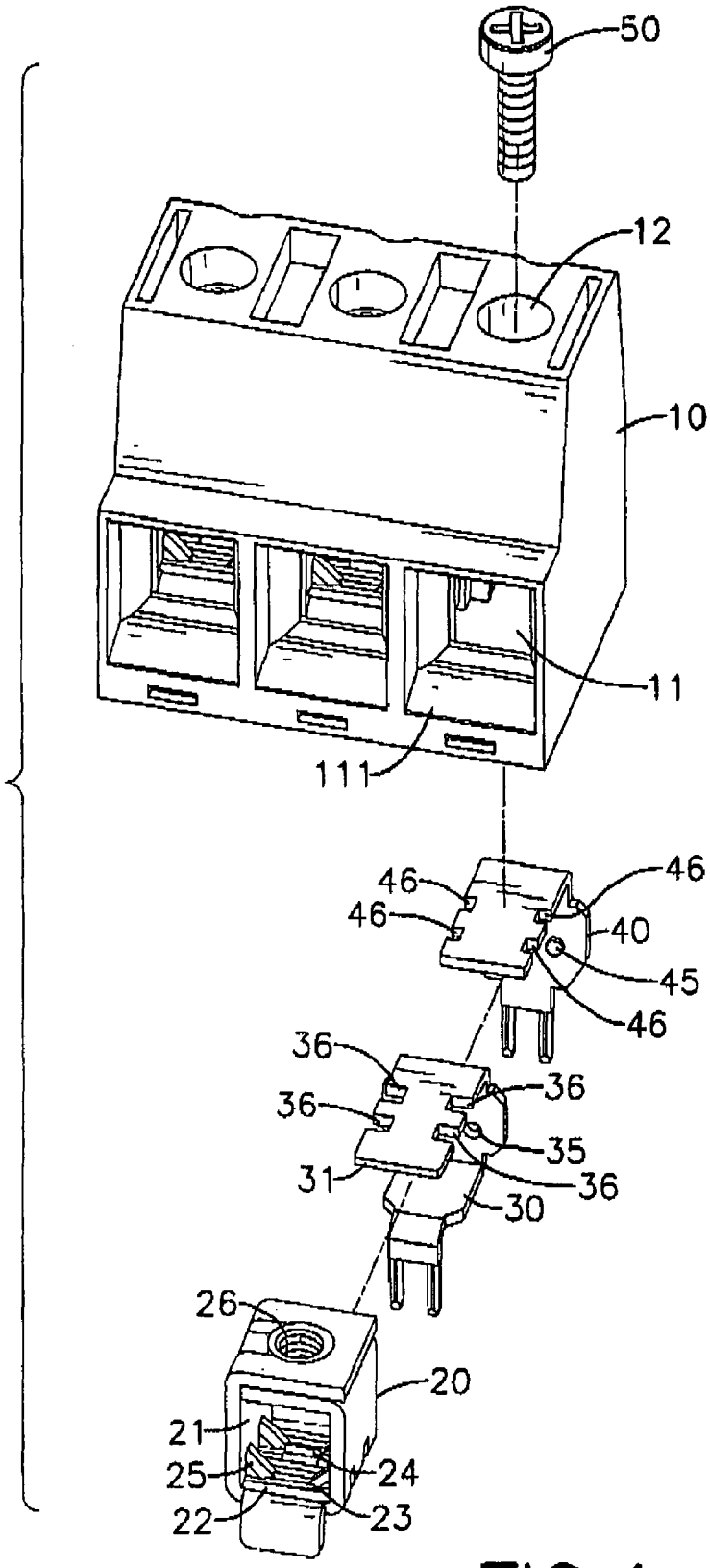
FIG. 1 is an exploded perspective view of a terminal contact and clamp assembly in accordance with the present invention and a casing of a cable terminal block.
Figure 2A:
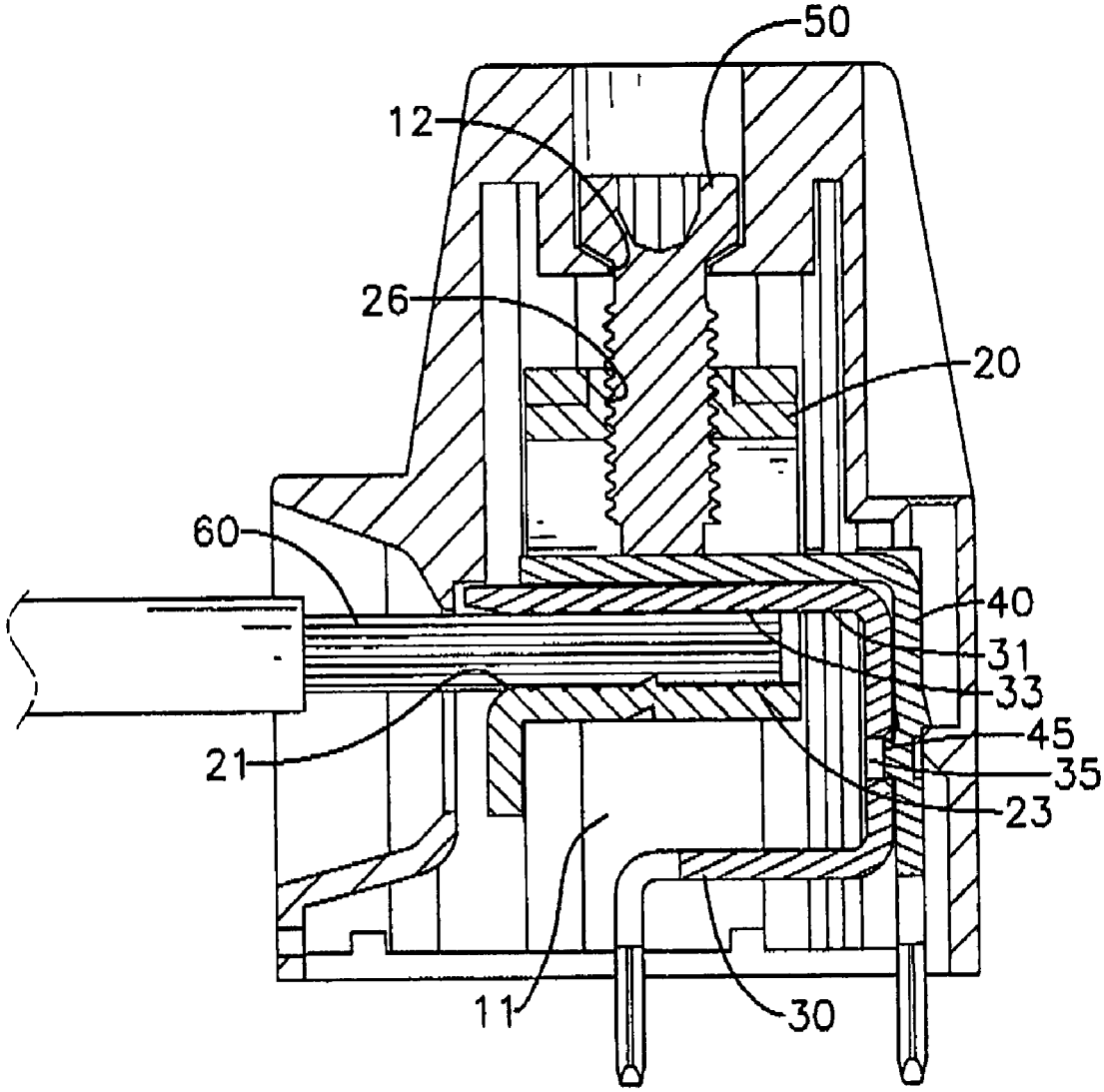
FIG. 2A is a side view in partial section of the casing and a terminal contact and clamp assembly in FIG. 1 holding an exposed wire core on one end of a cable.
Figure 2B:
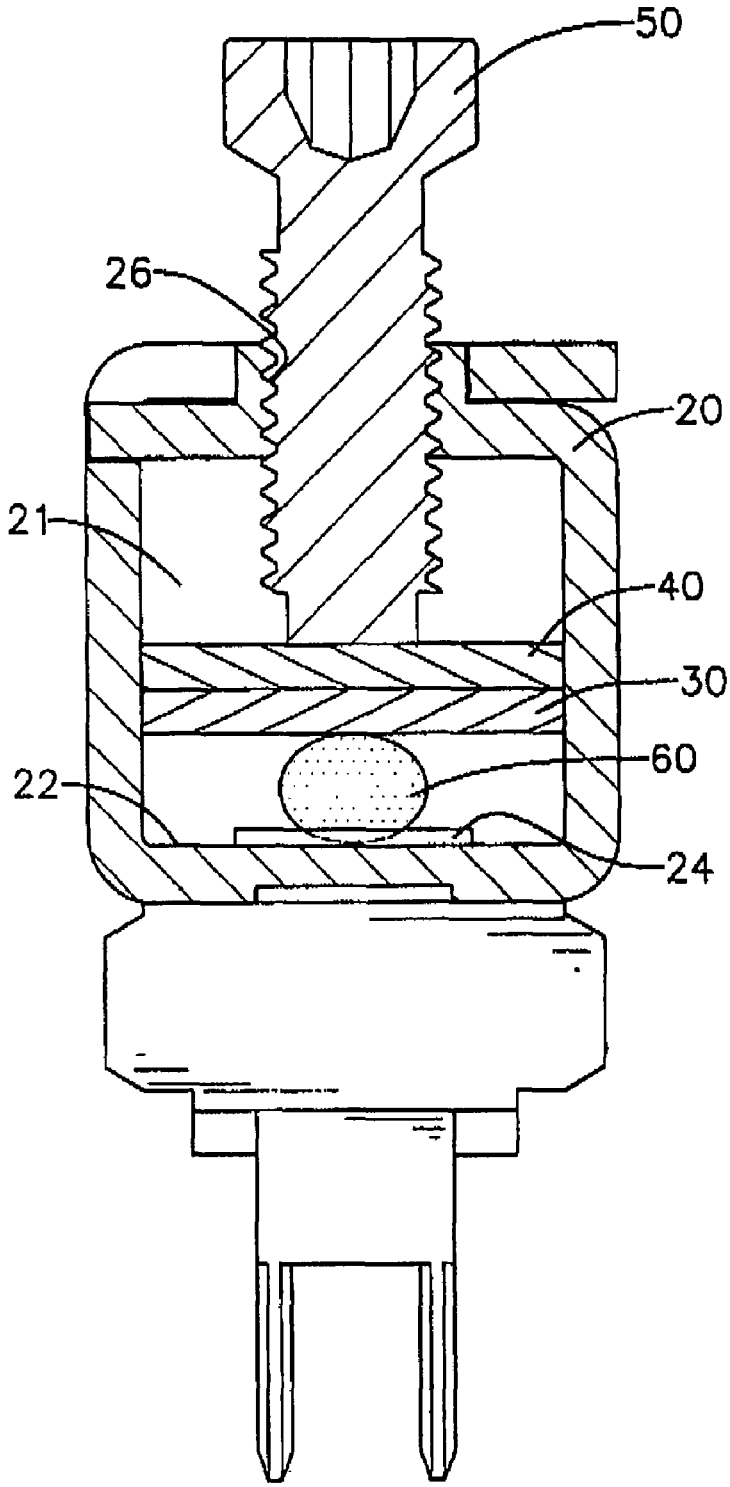
FIG. 2B is a front view of a cage clamp, inner contact and outer contact of the terminal contact and clamp assembly in FIG. 2A clamping the wire core of the cable with a protruding tooth partially cutting and holding the wire core.

With reference to FIGS. 1, 2A, 2B and 3A, terminal contact and clamp assemblies for a cable terminal block are mounted in a casing (10) of the cable terminal box. The casing (10) has a front, a top, multiple cavities (11) and multiple mounting holes (12). The cavities (11) are defined in the front of the casing (10), respectively accommodate the terminal contact and clamp assemblies and each cavity (11) has a front opening (111) to allow a cable (60) to extend in the cavity (11). The mounting holes (12) are defined in the top and communicate respectively with the cavities (11).

Each terminal contact and clamp assembly comprises a cage clamp (20), an inner contact (30), an outer contact (40) and a bolt (50).

The cage clamp (20) being hollow, made of metal, mounted in one cavity (11) in the casing (10), is rectangular and has a front open end, a rear open end, a top, a bottom, a through hole (21), a threaded hole (26), multiple bottom teeth (23), at least one protruding tooth (24) and four guides (25).

The bottom has an inner bottom surface (22) and an outer bottom surface opposite to the inner bottom surface (22). The inner bottom surface (22) has four corners.

The through hole (21) is defined laterally through the cage clamp (20) and communicates with the front open end and the rear open end.

The threaded hole (26) is defined through the top of the cage clamp (20) and communicates with the through hole (21).

The bottom teeth (23) are made of stainless steel, are formed on the inner bottom surface (22) of the bottom of the cage clamp (20) to bite an exposed wire core made of copper on one end of the cable (60) and each bottom tooth (23) has a top end flush with the inner bottom surface (22).

The at least one protruding tooth (24) is sharp and elongated, is formed transversely on and protrudes up from the inner bottom surface (22) of the bottom of the cage clamp (20) to deeply and tightly bite the exposed wire core on the cable (60) and especially cutting part of the cross-section of the wire and holding the wire core more deeply by using stainless steel material. Each protruding tooth has a top end higher than the inner bottom surface (22).

The guides (25) are slope-like, are formed respectively on the four corners of the inner bottom surface (22) of the bottom of the cage clamp (20) and each guide (25) has an inside inclined surface to smoothly contact and guide the exposed wire core of the cable (60) to a center of the bottom of the cage clamp (20).

Figure 4:
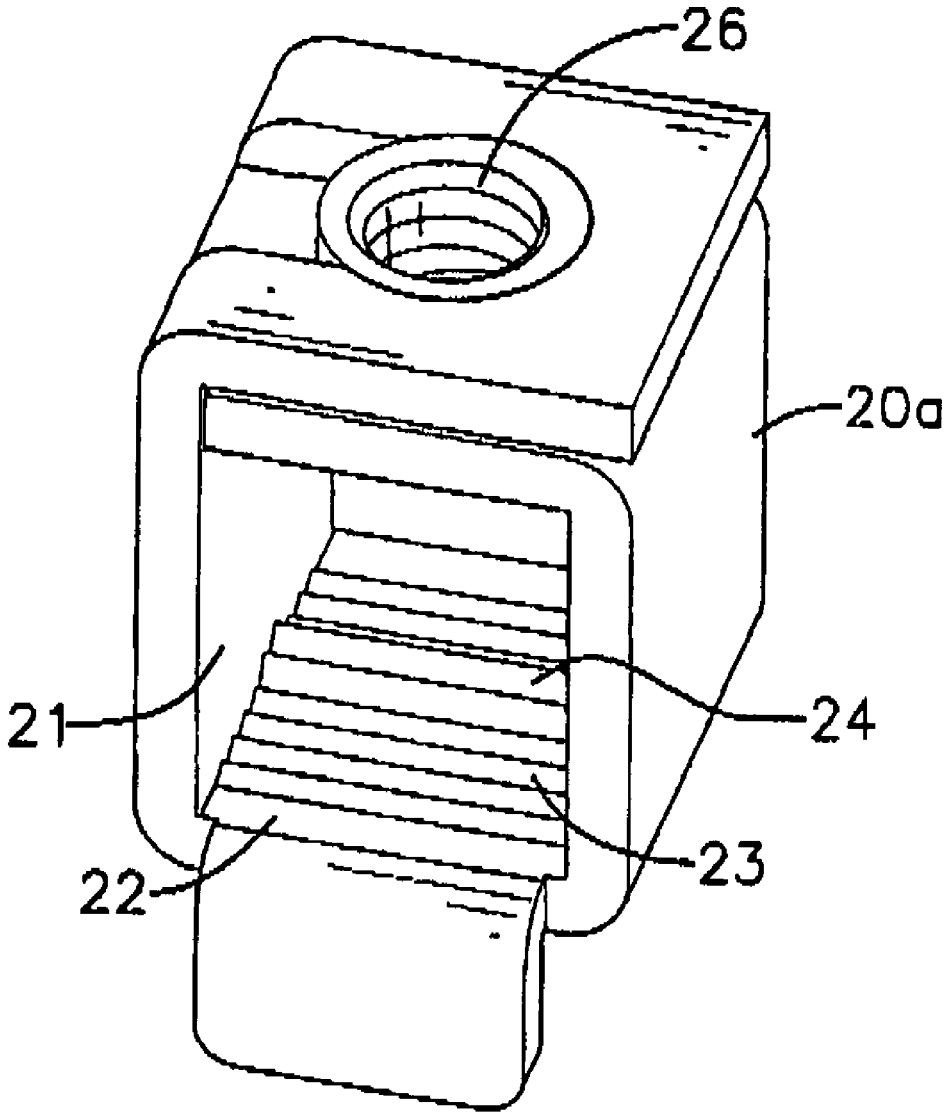
FIG. 4 is an enlarged perspective view of the cage clamp of the terminal contact and clamp assembly in FIG. 1 without the guides.

With further reference to FIG. 4, an embodiment of the cage clamp (20*a*) is implemented without the guides (25).

Figure 3A:
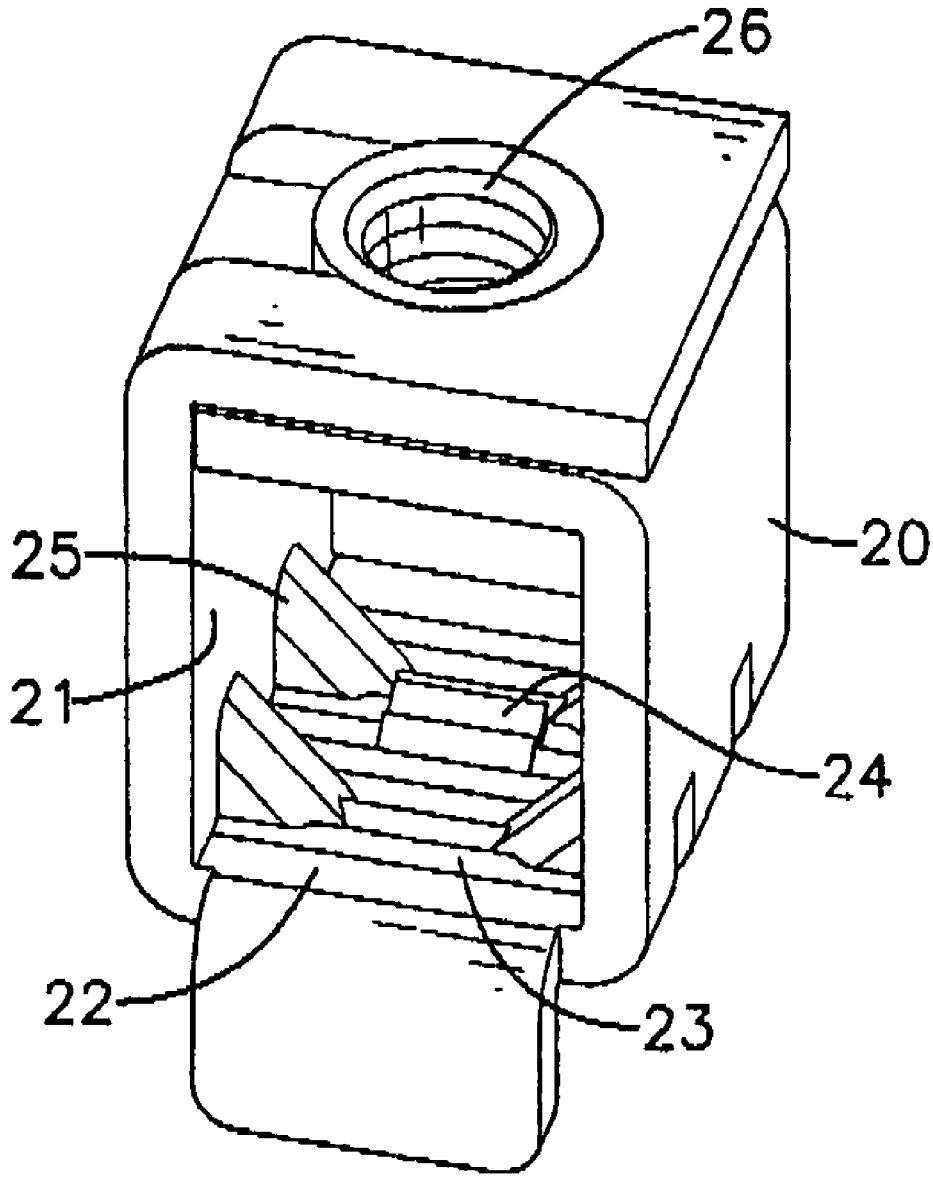
FIG. 3A is an enlarged perspective view of the cage clamp of the terminal contact and clamp assembly in FIG. 1.
Figure 3B:
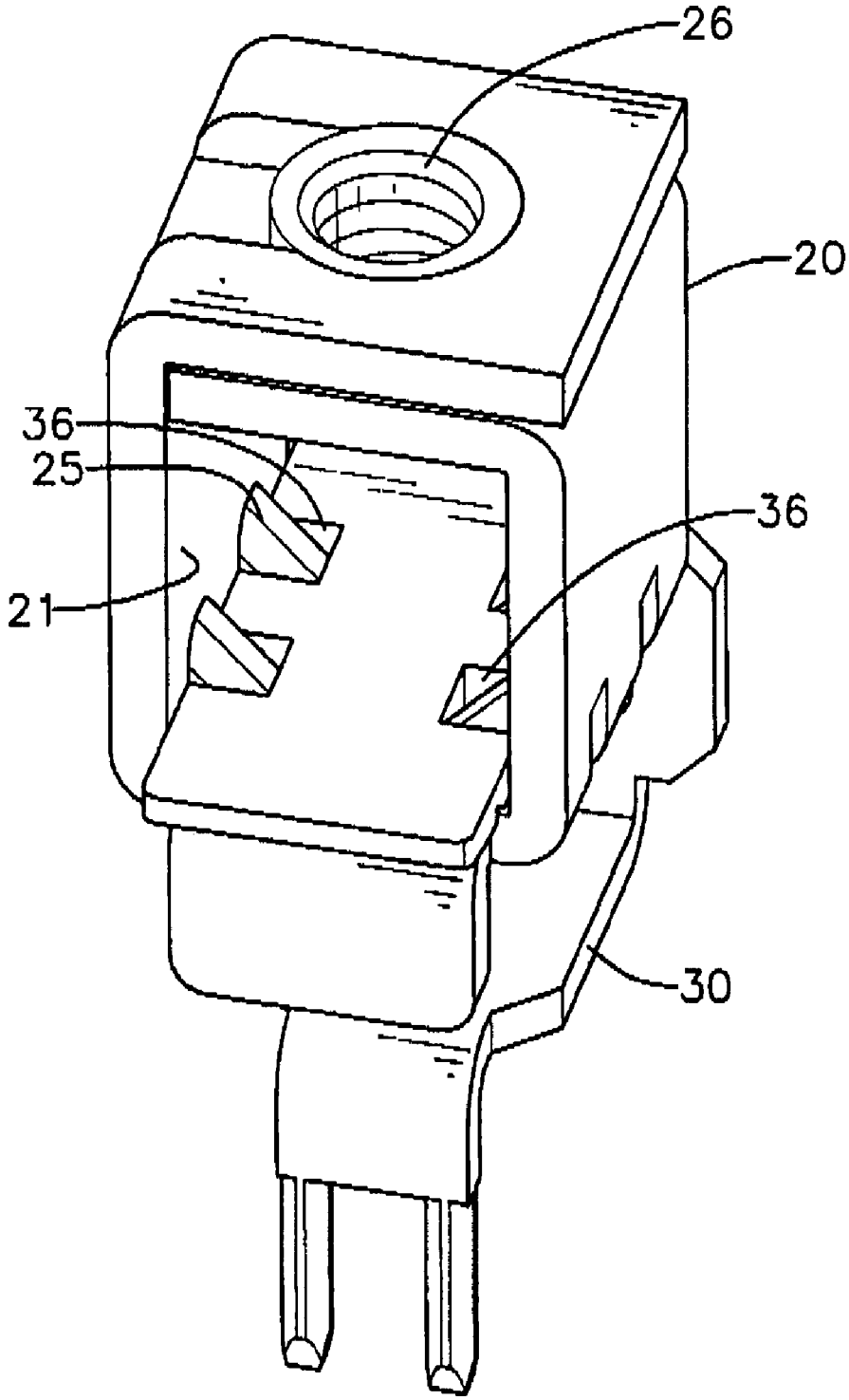
FIG. 3B is an enlarged perspective view of the cage clamp and the inner contact of the terminal contact and clamp assembly in FIG. 1.
Figure 3C:
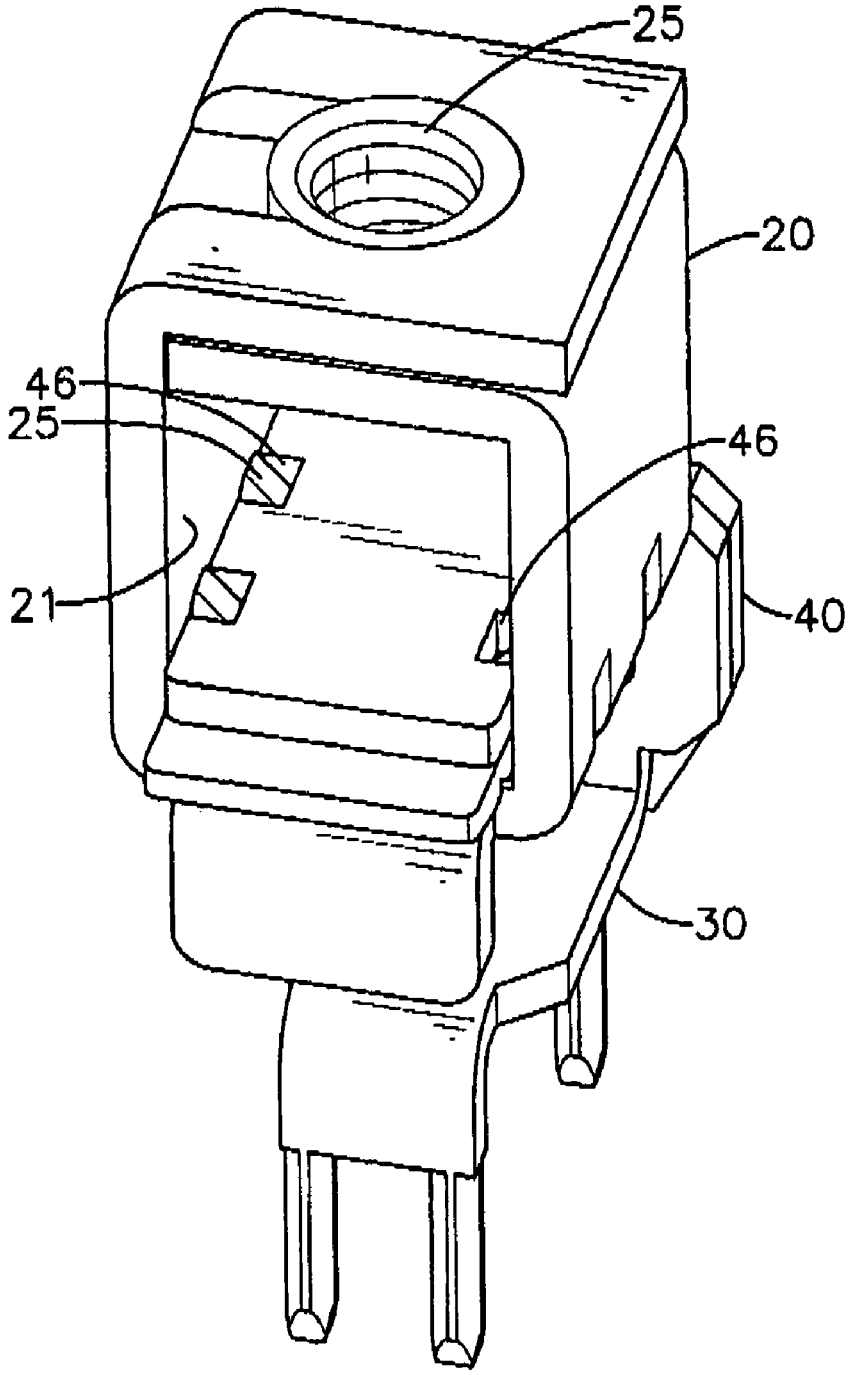
FIG. 3C is an enlarged perspective view of the cage clamp, inner contact and outer contact of the terminal contact and clamp assembly in FIG. 1.

With further reference to FIGS. 3B and 3C, the inner contact (30) is L-shaped, made of metal and is mounted through the rear open end of the cage clamp (20) in the through hole (21). Furthermore, the inner contact (30) cooperates with the bottom of the cage clamp (20) to tightly hold the exposed wire core of the cable (60) and has a top, a rear wall and multiple top teeth (33).

The top of the inner contact (30) is mounted through the rear open end of the cage clamp (20) in the through hole (21), has two opposite edges, an inner top surface (31) and two pairs of positioning notches (36). The positioning notches (36) of each pair are defined in one edge of the top and engaged respectively with two of the guides (25) on the cage clamp (20) to prevent the inner contact (30) from falling out of the through hole (21) of the cage clamp (20).

The rear wall of the inner contact (30) is formed on and protrudes perpendicularly from the top and may have at least one positioning hole (35). Each positioning hole (35) is defined through the rear wall.

The top teeth (33) are made of copper, are formed on the inner top surface (31) of the inner contact (30) and cooperate with the bottom teeth (23) and the at least one protruding tooth (24) of the cage clamp (20) to bite and tightly hold the exposed wire core of the cable (60). The top teeth (33) made of copper has lower rigidity when compared to stainless steel. When biting the wire core, the top teeth (33) pressing tightly against the wire core slightly deforms under high pressure to reduce gaps between the top teeth (33) and the wire core.

The outer contact (40) is L-shaped, is made of metal, is mounted through the rear open end of the cage clamp (20) in the through hole (21) and is stacked on the inner contact (30). The outer contact (40) has a top and a rear wall.

The top of the outer contact (40) is mounted through the rear open end of the cage clamp (20) in the through hole (21) and has two opposite edges and two pairs of positioning notches (46). The positioning notches (46) of each pair are defined in one edge of the top of the outer contact (40) and are engaged respectively with two of the guides (25) on the cage clamp (20) to prevent the outer contact (40) from falling out of the through hole (21) of the cage clamp (20).

The rear wall of the outer contact (40) is formed on and protrudes perpendicularly from the top and may have at least one positioning protrusion (45). The at least one positioning protrusion (45) is formed on and protrudes from the rear wall and is mounted respectively in the at least one positioning hole (35) to prevent the outer contact (40) from moving relative to the inner contact (30).

The bolt (50) is mounted through one of the mounting holes (12) in the casing (10), is mounted through the threaded hole (26) in the cage clamp (20) and presses against the outer contact (40) to press the inner contact (30) to hold the exposed wire core of the cable (60) with the bottom of the cage clamp (20). In an embodiment without the outer contact (40), the bolt (50) directly presses against the inner contact (30).

Figure 5:
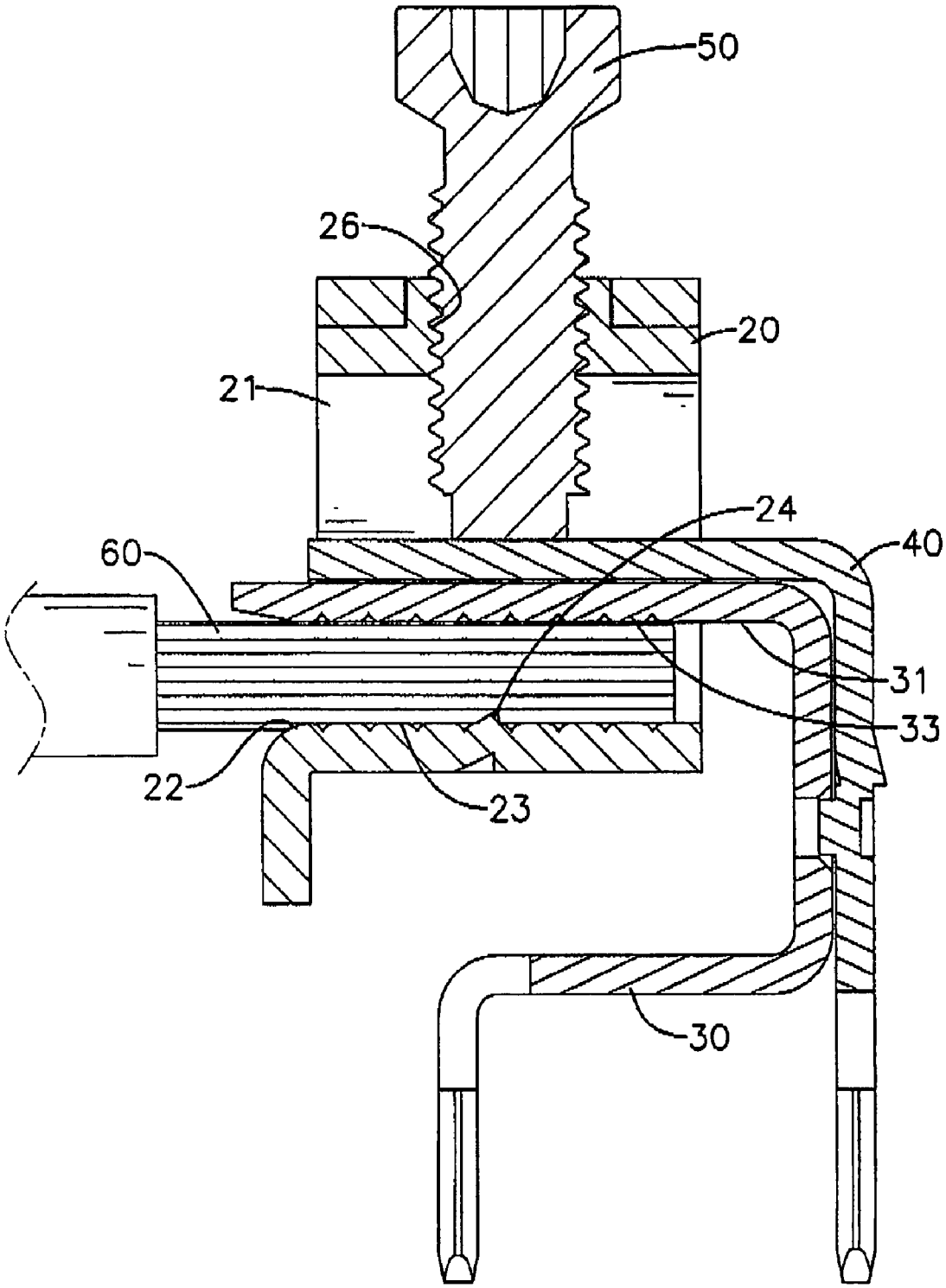
FIG. 5 is an enlarged side view in partial section of the terminal contact and clamp assembly in FIG. 2 holding the exposed wire core on one end of the cable.

With reference to FIG. 5, when the exposed wire core at the end of the cable (60) extends in the through hole (21) in the cage clamp (20), screwing the bolt (50) causes the inner contact (30) and the bottom of the cage clamp (20) to clamp the exposed wire core. The at least one protruding tooth (24) higher than the inner bottom surface (22) deeply bites and even pierces or cuts partially into the exposed wire core to tightly hold the exposed wire core in the terminal contact and clamp assembly. Even the wire core is a multi-core having a bundle of core elements and scatters due to the pressing force from the bolt (50), the at least one protruding tooth (24) being elongated still bites all of the core elements.

Figure 6A:
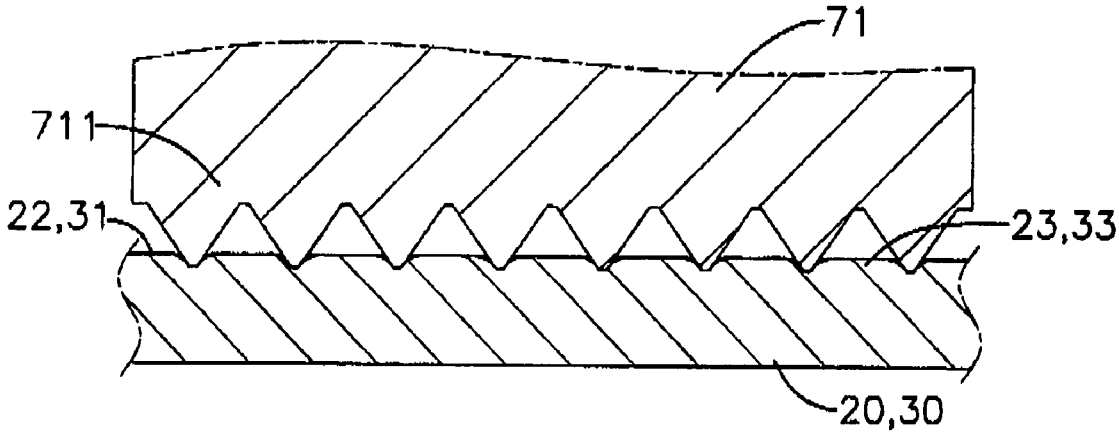
FIG. 6A is an operational cross sectional side view of the a punch die punching an inner bottom surface of a semi-finished cage clamp in a method for processing a terminal contact and clamp assembly in accordance with the present invention.
Figure 6B:
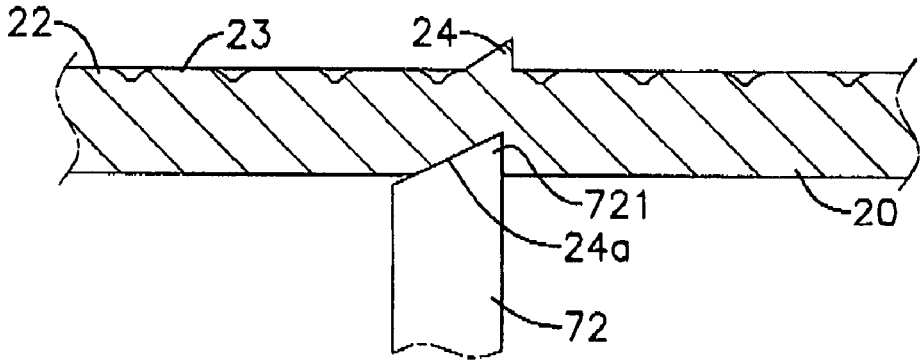
FIG. 6B is an operational side view in partial section of a second punch punching the outer bottom surface of the semi-finished cage clamp in the method in FIG. 6A to form the protruding tooth on the inner top surface.
Figure 6C:
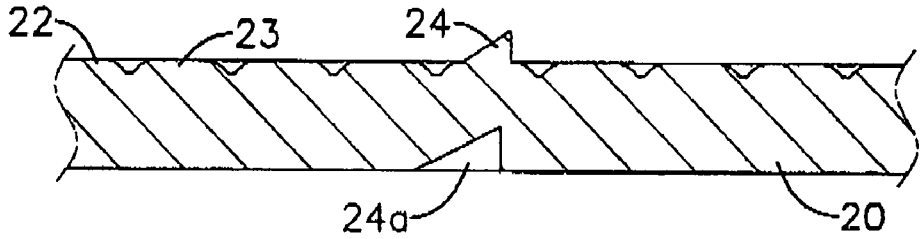
FIG. 6C is a cross sectional side view of the finished cage clamp of the terminal contact and clamp assembly made from the method in FIG. 6B.
Figure 7:
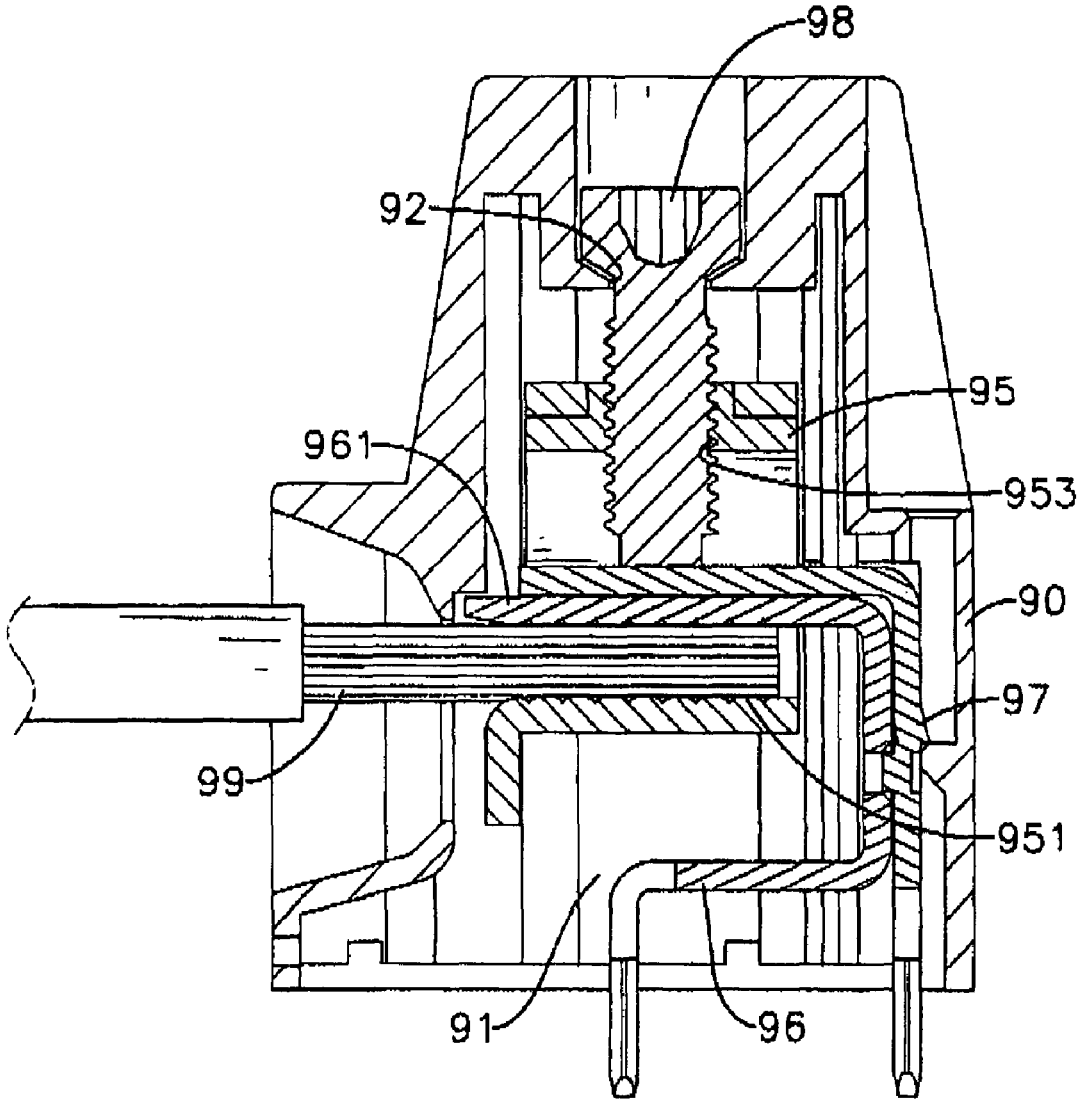
FIG. 7 PRIOR ART
FIG. 7 is a side view in partial section of a conventional contact and clamp assembly in accordance with the prior art mounted in a casing of a cable terminal block and holding an exposed wire core on one end of the cable.
Figure 8:
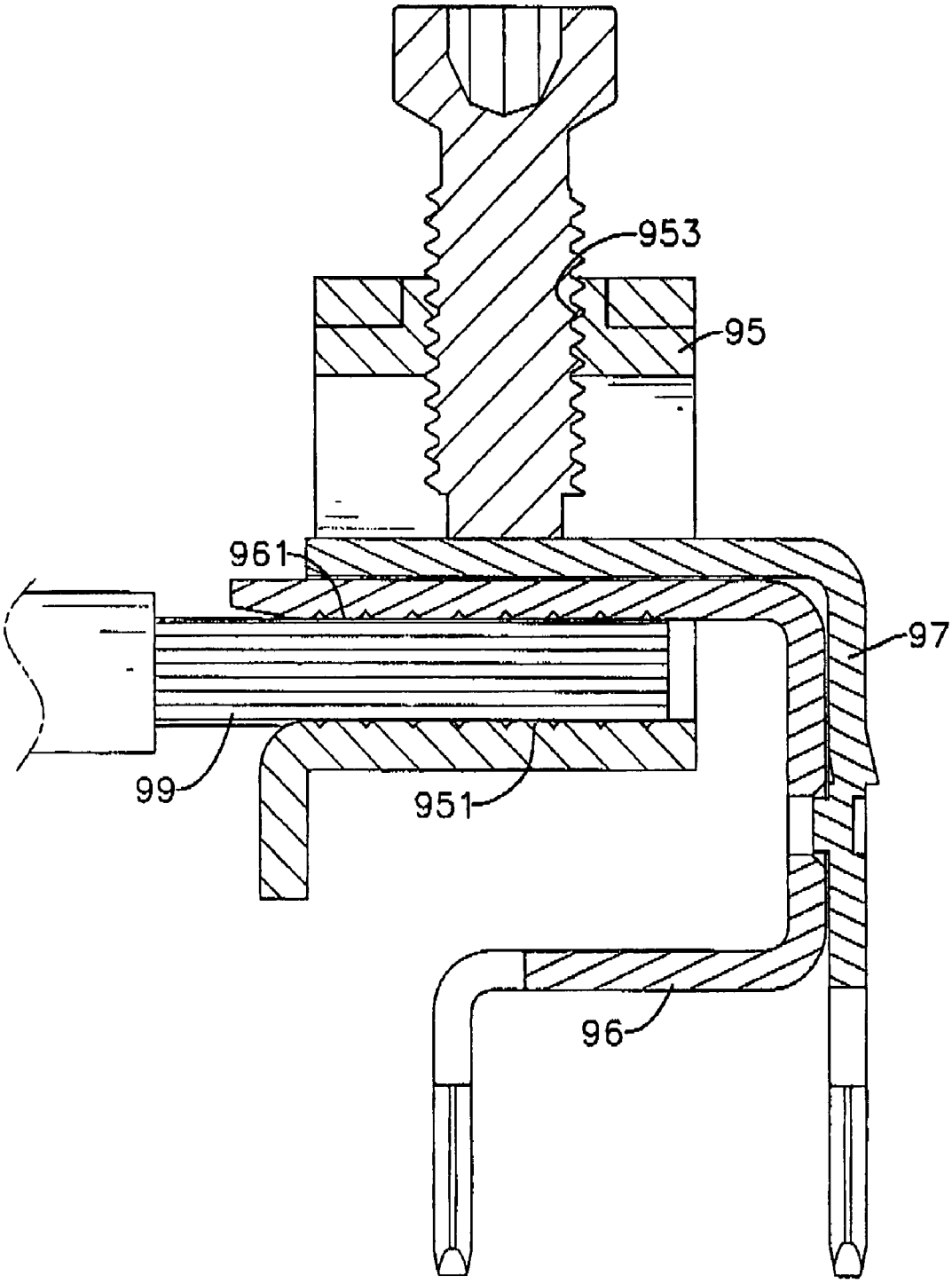
FIG.8 PRIOR ART
FIG. 8 is an enlarged side view in partial section of the conventional contact and clamp assembly holding the cable.
Figure 9A:
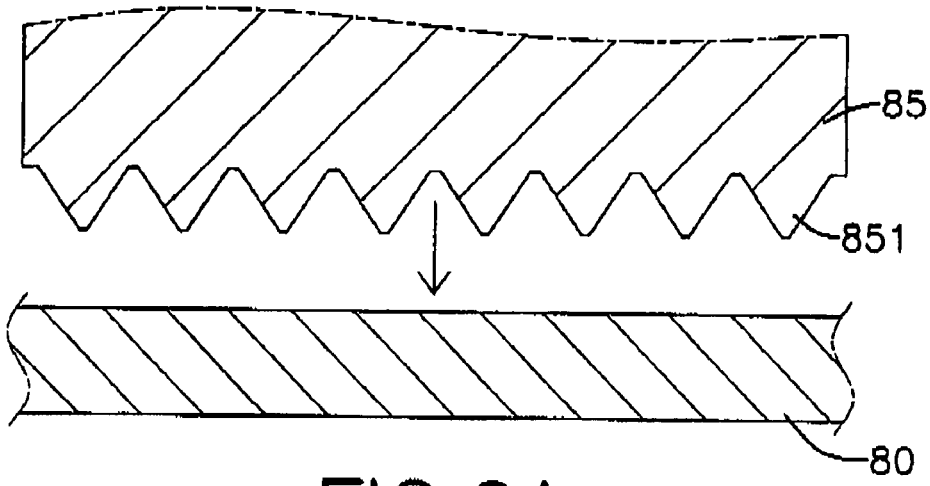
FIG.9A PRIOR ART
FIG. 9A is a cross sectional side view of the punch die aligned with the workpiece in a conventional method for processing the conventional contact and clamp assembly in accordance with the prior art.
Figure 9B:
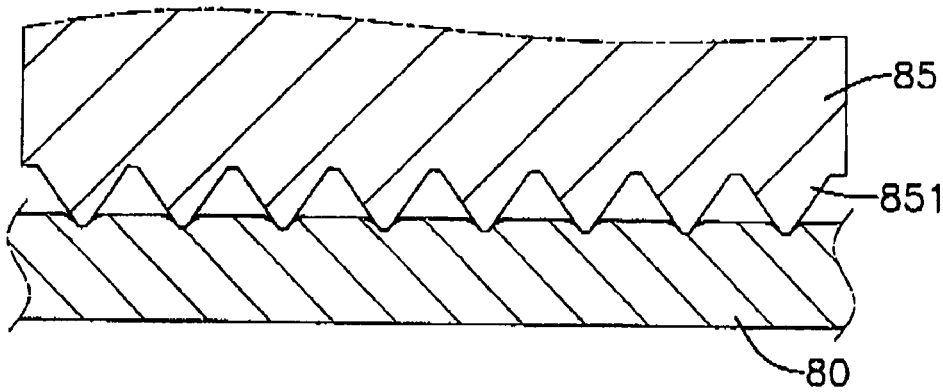
FIG.9B PRIOR ART
FIG. 9B is a cross sectional side view of the punch die punching the workpiece in FIG. 9A.
Figure 9C:
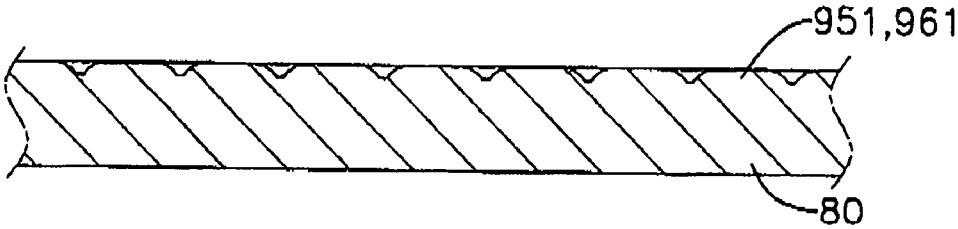
FIG.9C PRIOR ART
FIG. 9C is a cross sectional side view of the punched workpiece from FIG. 9B.

With reference to FIGS. 6A-6C, a method for processing a terminal contact and clamp assembly comprises a first punching step and a second punching step.

The first punching step comprises punching an inner bottom surface (22) of a bottom of a semi-finished cage clamp (20) and an inner top surface (31) of a top of a semi-finished inner contact (30) by multiple punching teeth (711) formed on a first punch die (71) to form multiple bottom teeth (23) on the inner bottom surface (22) and multiple top teeth (33) on the inner top surface (31).

The second punching step comprises punching an outer bottom surface of the semi-finished cage clamp (20) opposite to the inner bottom surface (22) by a sharp tooth (721) on a second punch die (72) to define at least one indent (24*a*) into the outer bottom surface and therefore to form at least one protruding tooth (24) on the inner bottom surface (22). The at least one protruding tooth (24) corresponds respectively to the at least one indent (24*a*) and has a top end higher than the inner bottom surface (22).

The terminal contact and clamp assembly and the method have following advantages.

1. The second punch die (72) punching the outer bottom surface forms the at least one tooth (24) on the inner bottom surface (22) of the cage clamp (20) instead of forming V-shaped grooves in the inner bottom surface (22). Therefore, the problem that the material of the cage clamp (20) cannot entirely fill the V-shaped grooves between the punching teeth of a conventional punch die is obviated. The height of the at least one protruding tooth (24) would be varied as desired.

2. The second punch die (72) would be made of iron or steel being harder than bronze or red copper so that the cage clamp (20) made of bronze or red copper would easily be punched by the second punch die (72) to form the at least one protruding tooth (24).

3. The at least one protruding tooth (24) would deeply bite and even pierce partially into the exposed wire core on the cable (60) so that the exposed wire core has a depressed and deformed section. The at least one protruding tooth (24) engages tightly with the depressed and deformed section to keep the cable (60) from slipping out of the terminal contact and clamp assembly when external force pulls the cable (60).

4. Even the wire core of the cable (60) is a multi-core having a bundle of core elements and the end of the bundle scatters as the wire core is depressed, the at least one protruding tooth (24) in an elongated configuration can bite all of the core element so that the scattering wire core would not slip out of the terminal contact and clamp assembly.

5. The guides (25) of the cage clamp (20) smoothly contact and guide the exposed wire of the cable to the center of the bottom of the cage clamp (20) and therefore facilitate the installation of the wire core of the cable (60) to the cable terminal box. Furthermore, the guides (25) engaged respectively with the positioning notches (36, 46) of the inner and outer contacts (30, 40) prevent the inner and outer contacts (30, 40) from falling out of the cage clamp (20) and therefore provide a firm connection of the cable (60) and the terminal contact and clamp assembly.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A terminal contact and clamp assembly for a cable terminal block comprising:

a cage clamp being hollow, made of metal and having a front open end, a rear open end and a top and further having a bottom having an inner bottom surface having four corners;

a through hole defined through the cage clamp and communicating with the front open end and the rear open end;

multiple bottom teeth formed on the inner bottom surface of the bottom of the cage clamp and each bottom tooth having a top end flush with the inner bottom surface;

at least one protruding tooth being sharp and formed transversely on and protruding up from the inner bottom surface of the bottom of the cage clamp, and each protruding tooth having a top end higher than the inner bottom surface; and four guides being slope-like, formed respectively on the four corners of the inner bottom surface of the bottom of the cage clamp and each guide having an inside inclined surface; and an inner contact being L-shaped, made of metal, mounted through the rear open end of the cage clamp, cooperating with the bottom of the cage clamp to be adapted to tightly hold an exposed wire core of a cable and having a top mounted through the rear open end of the cage clamp in the through hole and having two opposite edges, an inner top surface and two pair of positioning notches and, wherein the positioning notches of each pair are defined in one edge of the top and are engaged respectively with two of the guides on the cage clamp;

a rear wall; and multiple top teeth formed on the inner top surface of the inner contact.

2. The terminal contact and clamp assembly as claimed in claim 1, wherein the at least one protruding tooth is elongated.

3. The terminal contact and clamp assembly as claimed in claim 2, wherein the cage clamp further has a threaded hole defined through the top of the cage clamp and communicating with the through hole.

4. The terminal contact and clamp assembly as claimed in claim 3 further comprising an outer contact being L-shaped, made of metal, mounted through the rear open end of the cage clamp and stacked on the inner contact, and the outer contact having a top mounted through the rear open end of the cage clamp in the through hole and having two opposite edges and two pair of positioning notches, wherein the positioning notches of each pair are defined in one edge of the top of the outer contact and are engaged respectively with two of the guides on the cage clamp; and a rear wall.

5. The terminal contact and clamp assembly as claimed in claim 4, wherein:

the rear wall of the inner contact is formed on and protrudes perpendicularly from the top and has at least one positioning hole defined through the rear wall; and the rear wall of the outer contact is formed on and protrudes perpendicularly from the top and has at least one positioning protrusion formed on and protruding from the rear wall and mounted respectively in the at least one positioning hole.

* * * * *